US011085245B2

(12) United States Patent
Liu et al.

(10) Patent No.: US 11,085,245 B2
(45) Date of Patent: Aug. 10, 2021

(54) MULTI-PATH COMBINED HIGH-LOW VOLTAGE PLASMA ROCK-BREAKING DRILL BIT, DRILL BIT APPARATUS AND DRILLING METHOD

(71) Applicant: China University of Petroleum (East China), Shandong (CN)

(72) Inventors: Yonghong Liu, Shandong (CN); Qiang Sun, Shandong (CN); Qingyun Li, Shandong (CN); Renjie Ji, Shandong (CN); Baoping Cai, Shandong (CN); Xiaopeng Li, Shandong (CN); Yancong Han, Shandong (CN); Peng Liu, Shandong (CN); Dege Li, Shandong (CN); Xinlei Wu, Shandong (CN); Fan Zhang, Shandong (CN)

(73) Assignee: China University of Petroleum (East China), Shandong (CN)

( * ) Notice: Subject to any disclaimer, the term of this patent is extended or adjusted under 35 U.S.C. 154(b) by 0 days.

(21) Appl. No.: 16/735,376

(22) Filed: Jan. 6, 2020

(65) Prior Publication Data

US 2020/0217143 A1 Jul. 9, 2020

(30) Foreign Application Priority Data

Jan. 9, 2019 (CN) ..... 201910019930.4

(51) Int. Cl.

| | |
|---|---|
| ***E21B 7/15*** | (2006.01) |
| ***E21B 10/60*** | (2006.01) |
| ***E21B 36/00*** | (2006.01) |

(52) U.S. Cl.

CPC ..... *E21B 10/60* (2013.01); *E21B 7/15* (2013.01); *E21B 36/001* (2013.01)

(58) Field of Classification Search

CPC ..... E21B 7/14–15

See application file for complete search history.

(56) References Cited

U.S. PATENT DOCUMENTS

| | | | |
|---|---|---|---|
| 2012/0132466 | A1 | 5/2012 | Moeny |
| 2012/0217064 | A1 | 8/2012 | Moeny |

(Continued)

FOREIGN PATENT DOCUMENTS

| | | | |
|---|---|---|---|
| CN | 104563882 | A | 4/2015 |
| CN | 105008655 | A | 10/2015 |

(Continued)

*Primary Examiner* — Giovanna Wright

(74) *Attorney, Agent, or Firm* — IP & T Group LLP

(57) ABSTRACT

The present disclosure provides a multi-path combined high-low voltage plasma rock-breaking drill bit, drill bit apparatus and drilling method. The multi-path combined high-low voltage plasma rock-breaking drill bit comprises: a drill bit body, insulators, plasma generators, drilling fluid outlets, plasma integrated pipelines, a drilling fluid pipe; wherein a plurality of plasma generators are distributed on the same drill bit body; the axis of the plasma generator and the axis of the drill bit body form a certain included angle; each of the plasma generators is independently connected to the ground through its respective plasma integrated pipeline and operates independently; and drilling fluid flows out of the drilling fluid outlets, takes away the heat generated by the operation of the plasma generators, thereby cooling the plasma generators.

7 Claims, 3 Drawing Sheets

(56) References Cited

U.S. PATENT DOCUMENTS

| | | | | |
|---|---|---|---|---|
| 2013/0140086 | A1 | 6/2013 | Moeny | |
| 2015/0042145 | A1 * | 2/2015 | Grotendorst | E21B 7/15 299/14 |
| 2020/0224498 | A1 * | 7/2020 | Liu | E21B 10/60 |

FOREIGN PATENT DOCUMENTS

| | | | | |
|---|---|---|---|---|
| CN | 206545484 | U | 10/2017 | |
| CN | 108222838 | A | 6/2018 | |
| CN | 108222839 | A | 6/2018 | |
| WO | WO-2020092559 | A1 * | 5/2020 | E21B 7/15 |

* cited by examiner

MULTI-PATH COMBINED HIGH-LOW VOLTAGE PLASMA ROCK-BREAKING DRILL BIT, DRILL BIT APPARATUS AND DRILLING METHOD

The present application claims priority under 35 U.S.C. § 119(a) to Chinese Patent Application No. 2019100199304, filed on Jan. 9, 2019, the disclosure of which is incorporated herein by reference in its entirety.

BACKGROUND

Technical Field

The present application belongs to the field of oil engineering, and in particular relates to a multi-path combined high-low voltage plasma rock-breaking drill bit, a drill bit apparatus for drilling and a drilling method.

Description of the Related Art

With the constantly increasing depth of exploration and development of petroleum resources, geological conditions become more and more complex, and the difficulty in breaking rocks is increasing. The inadaptability of rotating machinery drilling technologies has become increasingly prominent, which mainly manifested in the serious wear of drill bits, low rock breaking efficiency, slow drilling speed and high cost. Plasma rock-breaking drilling is a new type of drilling technology which is configured to break rocks using the effects of plasma thermal energy impact, melting and so on. The method can overcome defects of the traditional rotary machinery rock-breaking method since the rock-breaking effect thereof is not affected by the hardness and strength of rock, and it is a new, efficient, economical and environmentally-friendly oil and gas drilling method.

At present, the plasma rock-breaking drill bit is divided into high-voltage pulsed plasma rock-breaking drill bit and plasma arc ablation rock-breaking drill bit. As to the former, inner and outer electrodes are quickly consumed under the erosion action of the pulsed arc since high-frequency pulsed arcs are generated between the inner and outer electrodes. Therefore, this type of drill bit has a short life span, high energy consumption, and unstable operation. As to the latter, when it operates, high temperature plasma is ejected from the anode nozzle, and thus the drill bit cannot carry much power, the borehole is small, and the anode is easily to be ablated. Therefore, it is especially necessary to develop a new type of plasma rock-breaking drill bit.

BRIEF SUMMARY

To overcome the deficiencies of the prior art, the present disclosure provides a multi-path combined high-low voltage plasma rock-breaking drill bit, a drill bit apparatus for drilling and a drilling method.

An embodiment of the present disclosure provides a multi-path combined high-low voltage plasma rock-breaking drill bit, comprising: a drill bit body, insulators, plasma generators, drilling fluid outlets, plasma integrated pipelines, a drilling fluid pipe; wherein a plurality of plasma generators are distributed on the same drill bit body; the axis of the plasma generator and the axis of the drill bit body form a certain included angle; each of the plasma generators is independently connected to the ground through its respective plasma integrated pipeline and operates independently; and drilling fluid flows out of the drilling fluid outlets, takes away the heat generated by the operation of the plasma generators, thereby cooling the plasma generators.

In an embodiment of the present disclosure, each of the plasma generators comprises a cathode holder, an anode holder, a cooling water core, an insulating ceramic, a cathode, an anode, and a plasma integrated pipeline; wherein the plasma integrated pipeline includes a gas-electric pipe, a water-electric pipe and a water return pipe; the gas-electric pipe is connected to a positive electrode of a plasma power source, and compressed gas is introduced inside the pipe; the positive electrode of the plasma power source is connected with the anode through the gas-electric pipe and the anode holder; the compressed gas passes through the gas-electric pipe and the anode holder in sequence, flows into the discharge gap between the cathode and the anode, and flows out of a nozzle of the anode; the water-electric pipe is connected to a negative electrode of the plasma power source, and cooling water is introduced inside the pipe; the negative electrode of the plasma power source is connected with the cathode through the water-electric pipe and the cathode holder; the cooling water flows through the water-electric pipe, the cathode holder, the cooling water core, and the cathode in sequence, and then returns from the gap between the outer wall of the cooling water core and the cathode, takes away the heat generated when the cathode operates, and is discharged by the water return pipe through an internal channel of the cathode holder.

According to a second aspect, an embodiment of the present disclosure provides a multi-path combined high-low voltage plasma rock-breaking drill bit, comprising a drill bit body whose drilling surface is provided with a plurality of plasma generators and drilling fluid outlets, wherein each plasma generator is configured to be electrically connected to its corresponding combined high-low voltage pulse power source; and the drilling fluid outlets are configured to be in communication with a drilling fluid supply apparatus.

In an embodiment of the present disclosure, a center-position plasma generator is disposed at a central position of the drilling surface of the drill bit body; and a plurality of side-position plasma generators are disposed on the drilling surface by way of outward radiation centering on the central position, and each of the center-position plasma generator and the side-position plasma generators is configured to be electrically connected to its corresponding combined high-low voltage pulse power source.

In an embodiment of the present disclosure, the drilling fluid outlets are disposed around the plasma generators.

In an embodiment of the present disclosure, an insulator is disposed between the plasma generator and the drill bit body.

According to a third aspect, an embodiment of the present disclosure provides a drill bit apparatus for drilling, comprising a drill bit and a driving device, wherein the drill bit is the above-mentioned multi-path combined high-low voltage plasma rock-breaking drill bit, and the driving device is linked with the drill bit for driving the drill bit to rotate reciprocally in the range of 360°.

In an embodiment of the present disclosure, the drill bit apparatus for drilling further comprises the combined high-low voltage pulse power sources and the drilling fluid supply apparatus; each plasma generator is electrically connected to its corresponding combined high-low voltage pulse power source; and the drilling fluid outlets are in communication with the drilling fluid supply apparatus.

According to a fourth aspect, an embodiment of the present disclosure provides a multi-path combined high-low voltage plasma drilling method, the drilling method uses the above-mentioned drill bit apparatus for drilling and comprises: rotating the drill bit at the bottom of a drilling well, allowing a plurality of combined high-low voltage pulse power sources to control the corresponding plasma generators respectively during the rotation process, so that the plasma generators emit high-frequency pulsed plasma arcs to break rocks on the wall of the drilling well; and in the process that the plasma generators emit high-frequency pulsed plasma arcs, releasing drilling fluid by the drilling fluid supply apparatus to the bottom of the drilling well through the drilling fluid outlets.

According to the multi-path combined high-low voltage plasma rock-breaking drill bit, a drill bit apparatus for drilling and a drilling method provided by the embodiments of the present disclosure, by disposing the plurality of plasma generators and making each plasma generator have an independent combined high-low voltage pulse power source to provide energy, it is not necessary to design a power source with large power, electrode loss of the drill bit is reduced, the rock-breaking operation can be performed at a large bottom area of the drilling well from multiple angles, and the high drilling energy utilization rate is achieved. In addition, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

BRIEF DESCRIPTION OF THE DRAWINGS

In order to more clearly illustrate the technical solutions disclosed in the embodiments of the present disclosure or the prior art, the drawings used in the descriptions of the embodiments or the prior art will be briefly described below. Obviously, the drawings in the following description are only certain embodiments of the present disclosure, and other drawings can be obtained according to these drawings without any creative work for those skilled in the art.

DETAILED DESCRIPTION

In order to make the object, technical solutions and advantages of the embodiments of the present disclosure more clear, the technical solutions in the embodiments of the present disclosure are clearly and completely described below in conjunction with the accompanying drawings in the embodiments of the present disclosure. Obviously, the described embodiments are part of the embodiments of the present disclosure, and not all of the embodiments. All other embodiments obtained by a person of ordinary skill in the art based on the embodiments of the present disclosure without any creative work belong to the scope of the present disclosure.

Figure 1:
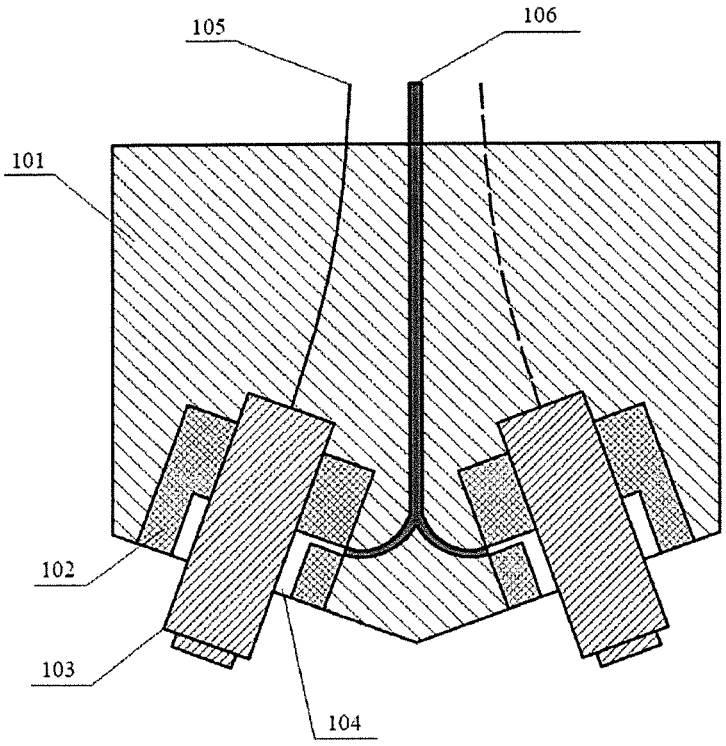
FIG. 1 is a schematic structural view of a multi-path combined high-low voltage plasma rock-breaking drill bit according to an embodiment of the present disclosure.

FIG. 1 is a schematic structural view of a multi-path combined high-low voltage plasma rock-breaking drill bit according to an embodiment of the present disclosure. The multi-path combined high-low voltage plasma rock-breaking drill bit comprises: a drill bit body 101, insulators 102, plasma generators 103, drilling fluid outlets 104, plasma integrated pipelines 105, a drilling fluid pipe 106; wherein the insulators 102 are mounted on the drill bit body 101; the plasma generators 103 are mounted on the insulators 102; the plasma generators 103 and the drill bit body 101 are insulated with each other by the insulators 102; a plurality of plasma generators are distributed on the same drill bit body 101; the axis of the plasma generator 103 and the axis of the drill bit body 101 form a certain included angle; the plasma integrated pipelines 105 are connected to the plasma generators 103 and plasma power sources and auxiliary apparatuses on the ground; each of the plasma generators is independently connected to the ground through its respective plasma integrated pipeline and operates independently; gaps between the insulators 102 and the plasma generators 103 constitute the drilling fluid outlets 104; the drilling fluid pipe 106 is connected to a drilling fluid pump on the ground and the insulators 102; drilling fluid is pumped by the drilling fluid pump on the ground, flows into drilling fluid channels in the insulators 102 through the drilling fluid pipe 106, and then flows out of the drilling fluid outlets 104; when flowing out of the drilling fluid outlets 104, the drilling fluid takes away the heat generated by the operation of the plasma generators 103 so as to cool the plasma generators 103; and the drilling fluid flows into the gap between the plasma drill bit and rocks from the drilling fluid outlets 104 and takes away broken rocks.

Figure 2:
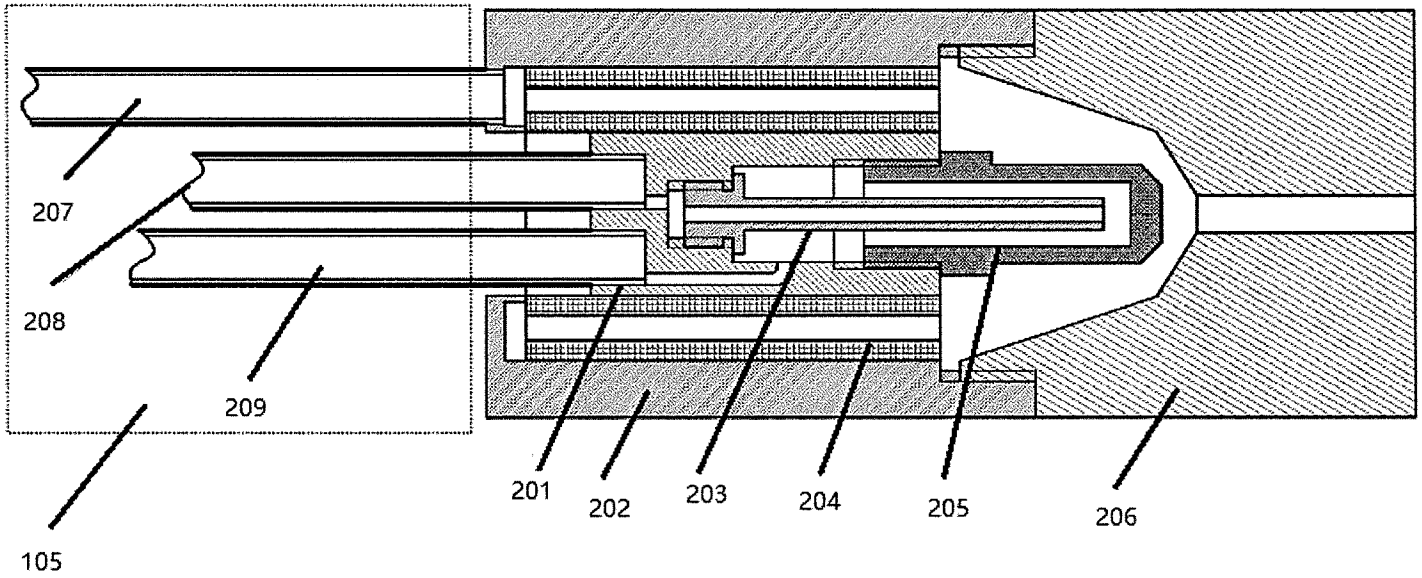
FIG. 2 is a schematic structural view of a plasma generator according to an embodiment of the present disclosure.

FIG. 2 is a schematic structural view of a plasma generator according to an embodiment of the present disclosure. The plasma generator comprises: a cathode holder 201, an anode holder 202, a cooling water core 203, an insulating ceramic 204, a cathode 205, an anode 206, and a plasma integrated pipeline 105; wherein the plasma integrated pipeline 105 includes a gas-electric pipe 207, a water-electric pipe 208 and a water return pipe 209; the cathode holder 201 is connected with the cooling water core 203 by threads; the cathode 205 is connected with the cathode holder 201 by threads; the cooling water core 203 goes deep inside the cathode 205; the insulating ceramic 204 is wrapped outside the cathode holder 201; gas holes are uniformly distributed in the tube wall of the insulating ceramic 204; the anode holder 202 is bonded to the outside of the insulating ceramic 204; the anode 206 in connected with the anode holder 202 by threads; the gas-electric pipe 207 is welded at the tail of the anode holder 202; the water-electric pipe 208 and water return pipe 209 are welded at the tail of the cathode holder 201; both the gas-electric pipe 207 and water-electric pipe 208 are metal pipes wrapped with insulating material on the outer surface; the water return pipe 209 is a non-metallic material pipe and is non-conductive; when the plasma generator operates, the gas-electric pipe 207 is connected to a positive electrode of a plasma power source, and compressed gas is introduced inside the pipe; the positive electrode of the plasma power source is connected with the anode 208 through the gas-electric pipe 207 and the anode holder 202; the compressed gas passes through the gas-electric pipe 207 and the anode holder 202 in sequence, flows into the discharge gap between the cathode 205 and the anode 206, and flows out of a nozzle of the anode 206; the water-electric pipe 208 is connected to a negative electrode of the plasma power source, and cooling water is introduced inside the pipe; the negative electrode of the plasma power source is connected with the cathode 205 through the water-electric pipe 208 and the cathode holder 201; the cooling water flows through the water-electric pipe 208, the cathode holder 201, the cooling water core 203, and the cathode 205 in sequence, and then returns from the gap between the outer wall of the cooling water core 203 and the cathode 205, takes away the heat generated when the cathode 205 operates, and is discharged by the water return pipe 209 through an internal channel of the cathode holder 201; and in the initial stage of the plasma generator operation, the plasma power source applies high-frequency and high-voltage pulse signals between the positive and negative electrodes, the pulse signals are respectively applied between the anode 206 and the cathode 205 of the plasma generator through the gas-electric pipe 207 and the water-electric pipe 208, so that the air between the anode 206 and the cathode 205 is broken down to form a plasma discharge channel, resistance heat generated by the discharge channel continuously ionizes subsequent compressed gas, and the plasma generator continues to operate.

Figure 3:
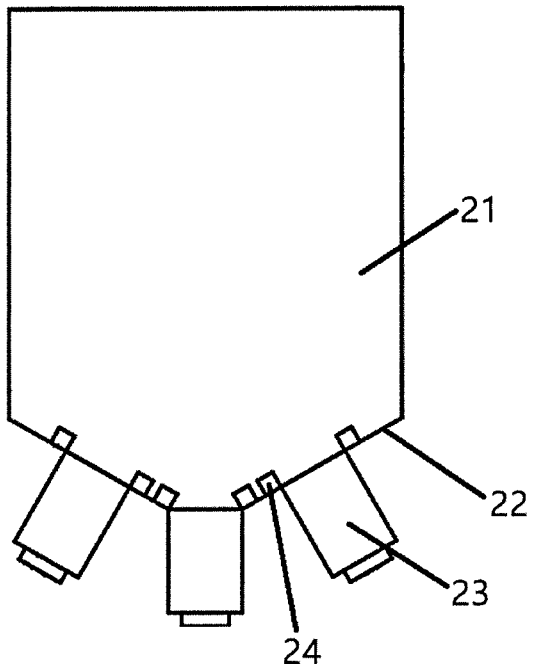
FIG. 3 is a schematic structural view of a multi-path combined high-low voltage plasma rock-breaking drill bit according to an embodiment of the present disclosure.

FIG. 3 is a schematic structural view of a multi-path combined high-low voltage plasma rock-breaking drill bit according to an embodiment of the present disclosure. As can be seen from FIG. 3, the drill bit comprises a drill bit body 21 whose drilling surface 22 is provided with a plurality of plasma generators 23 and drilling fluid outlets 24, wherein each plasma generator 23 is configured to be electrically connected to its corresponding combined high-low voltage pulse power source; and the drilling fluid outlets 24 are configured to be in communication with a drilling fluid supply apparatus.

It should be noted that since the drill bit is provided with the plurality of plasma generators and each plasma generator has an independent combined high-low voltage pulse power source to provide energy, it is not necessary to design a power source with large power, electrode loss of the drill bit is reduced, the rock-breaking operation can be performed at a large bottom area of the drilling well from multiple angles, and the high drilling energy utilization rate is achieved.

In a further embodiment of the multi-path combined high-low voltage plasma rock-breaking drill bit of the embodiment above, in order to better perform uniform operation on the bottom area of the drilling well, a center-position plasma generator is disposed at a central position of the drilling surface of the drill bit body; and a plurality of side-position plasma generators are disposed on the drilling surface by way of outward radiation centering on the central position, and each of the center-position plasma generator and the side-position plasma generators is configured to be electrically connected to its corresponding combined high-low voltage pulse power source.

In a further embodiment of the drill bit of the embodiment above, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

In addition, an insulator is disposed between the plasma generator and the drill bit body, such that the plasma generators and the drill bit body are insulated with each other.

An embodiment of the present disclosure provides a drill bit apparatus for drilling, comprising a drill bit and a driving device, wherein the drill bit is the multi-path combined high-low voltage plasma rock-breaking drill bit mentioned in the above embodiments, and the driving device is linked with the drill bit for driving the drill bit to rotate reciprocally in the range of 360°, thereby performing rock-breaking operation at a relatively large bottom area from multiple angles on the bottom of the drilling well and achieving the purpose of high utilization efficiency of the drilling energy, In a further embodiment of the drill bit apparatus for drilling of the embodiment above, the drill bit apparatus for drilling further comprises combined high-low voltage pulse power sources and a drilling fluid supply apparatus; each plasma generator is electrically connected to its corresponding combined high-low voltage pulse power source; and the drilling fluid outlets are in communication with the drilling fluid supply apparatus.

When the drill bit apparatus for drilling mentioned in the above embodiments performs the drilling operation, each of the plasma generator eject high-frequency pulsed plasma arc under the control of its corresponding combined high-low voltage pulse power source on the ground; the high-frequency pulsed plasma arc is ejected onto a wall of a drilling well, impulsive high temperature thermal shock stress is formed inside the rocks on the wall of the drilling well, and the rocks are broken under the shock of thermal stress to form rock debris; high-pressure drilling fluid is pumped from the ground and is sprayed through the drilling fluid outlets; the drilling fluid cools the plasma generators; the drilling fluid discharges the rock debris from the gap between the plasma drill bit and the rocks and carries it to the ground; the plasma drill bit makes reciprocating rotation movement in the range of 360° under the driving of a ground control system; and the plasma arcs ejected from the plurality of plasma generators jointly scan the entire wellbore area for efficient rock-breaking and drilling.

Figure 4:
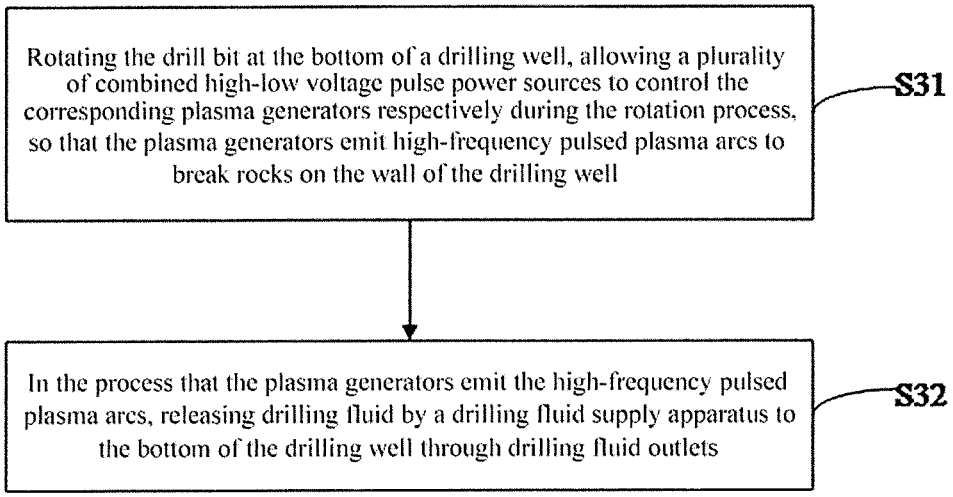
FIG. 4 is a flow chart of a multi-path combined high-low voltage plasma drilling method according to an embodiment of the present disclosure.

FIG. 4 is a flow diagram of a multi-path combined high-low voltage plasma drilling method according to an embodiment of the present disclosure. The drilling method uses the above-mentioned drill bit apparatus for drilling process and comprises: S31, rotating the drill bit at the bottom of a drilling well, allowing a plurality of combined high-low voltage pulse power sources to control the corresponding plasma generators respectively during the rotation process, so that the plasma generators emit high-frequency pulsed plasma arcs to break rocks on a wall of the drilling well; and S32, in the process that the plasma generators emit the high-frequency pulsed plasma arcs, releasing drilling fluid by a drilling fluid supply apparatus to the bottom of the drilling well through drilling fluid outlets.

According to the drilling method, by disposing the plurality of plasma generators and making each plasma generator have an independent combined high-low voltage pulse power source, it is not necessary to design a power source with large power, electrode loss of the drill bit is reduced, the rock-breaking operation can be performed at a large bottom area of the drilling well from multiple angles, and the high drilling energy utilization rate is achieved. In addition, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

Through the description of the embodiments above, those skilled in the art can clearly understand that the various embodiments can be implemented by means of software and a necessary general hardware platform, and of course, by hardware. Based on such understanding, the above-mentioned technical solutions in essence or a part thereof that contributes to the prior art, may be embodied in the form of a software product, which may be stored in a computer-readable storage medium such as ROM/RAM, magnetic Discs, optical discs, etc., including several instructions to cause a computer device (which may be a personal computer, server, or network device, etc.) to perform the methods described by various embodiments or some parts of the embodiments.

Finally, it should be noted that the above embodiments are only used to explain the technical solutions of the present disclosure, and are not limited thereto; although the present disclosure is described in detail with reference to the foregoing embodiments, it should be understood by those skilled in the art that they can still modify the technical solutions described in the foregoing embodiments and make equivalent replacements to a part of the technical features therein; and these modifications and replacements do not depart from the spirit and scope of the technical solutions of the embodiments of the present disclosure.

The invention claimed is:

1. A multi-path combined high-low voltage plasma rock-breaking drill bit, comprising: a drill bit body, insulators, a plurality of plasma generators, drilling fluid outlets, plasma integrated pipelines, and a drilling fluid pipe;

wherein the plurality of the plasma generators are distributed on the same drill bit body; an axis of each of the plurality of the plasma generators and an axis of the drill bit body form a certain included angle; each of the plurality of the plasma generators operates independently and includes a plasma integrated pipeline for connecting with a ground; and drilling fluid flows out of the drilling fluid outlets, takes away the heat generated by the operation of the plurality of the plasma generators, thereby cooling the plurality of the plasma generators;

wherein each of the plurality of the plasma generators further comprises: a cathode holder, an anode holder, a cooling water core, an insulating ceramic, a cathode, and an anode;

wherein each of the plasma integrated pipelines includes a gas-electric pipe, a water-electric pipe and a water return pipe; the gas-electric pipe is connected to a positive electrode of a plasma power source, and compressed gas is introduced inside the gas-electric pipe; the positive electrode of the plasma power source is connected with the anode through the gas-electric pipe and the anode holder; the compressed gas passes through the gas-electric pipe and the anode holder in sequence, flows into a discharge gap between the cathode and the anode, and flows out of a nozzle of the anode; the water-electric pipe is connected to a negative electrode of the plasma power source, and cooling water is introduced inside the water-electric pipe; the negative electrode of the plasma power source is connected with the cathode through the water-electric pipe and the cathode holder; the cooling water flows through the water-electric pipe, the cathode holder, the cooling water core, and the cathode in sequence, and then returns from a gap between an outer wall of the cooling water core and the cathode, takes away the heat generated when the cathode operates, and is discharged by the water return pipe through an internal channel of the cathode holder.

2. A multi-path combined high-low voltage plasma rock-breaking drill bit, comprising a drill bit body whose drilling surface is provided with a plurality of plasma generators and drilling fluid outlets, wherein each of the plurality of the plasma generators is configured to be electrically connected to a combined high-low voltage pulse power source corresponding to each plasma generator; and the drilling fluid outlets are configured to be in communication with a drilling fluid supply apparatus, and an insulator is disposed between each plasma generator and the drill bit body;

wherein each of the plurality of the plasma generators comprises: a cathode holder, an anode holder, a cooling water core, an insulating ceramic, a cathode, and an anode;

wherein each of plasma integrated pipelines includes a gas-electric pipe, a water-electric pipe and a water return pipe; the gas-electric pipe is connected to a positive electrode of a plasma power source, and compressed gas is introduced inside the gas-electric pipe; the positive electrode of the plasma power source is connected with the anode through the gas-electric pipe and the anode holder; the compressed gas passes through the gas-electric pipe and the anode holder in sequence, flows into a discharge gap between the cathode and the anode, and flows out of a nozzle of the anode; the water-electric pipe is connected to a negative electrode of the plasma power source, and cooling water is introduced inside the water-electric pipe; the negative electrode of the plasma power source is connected with the cathode through the water-electric pipe and the cathode holder; the cooling water flows through the water-electric pipe, the cathode holder, the cooling water core, and the cathode in sequence, and then returns from a gap between an outer wall of the cooling water core and the cathode, takes away the heat generated when the cathode operates, and is discharged by the water return pipe through an internal channel of the cathode holder.

3. The multi-path combined high-low voltage plasma rock-breaking drill bit of claim 2, wherein a center-position plasma generator is disposed at a central position of the drilling surface of the drill bit body; and a plurality of side-position plasma generators are disposed on the drilling surface by way of outward radiation centering on the central position, and each of the center-position plasma generator and the side-position plasma generators is configured to be electrically connected to a combined high-low voltage pulse power source corresponding to each of the center-position plasma generator and the side-position plasma generators.

4. The multi-path combined high-low voltage plasma rock-breaking drill bit of claim 3, wherein the drilling fluid outlets are disposed around the plasma generators.

5. A drill bit apparatus for drilling, comprising a drill bit and a driving device, wherein the drill bit is the multi-path combined high-low voltage plasma rock-breaking drill bit according to claim 2, and the driving device is linked with the drill bit for driving the drill bit to rotate reciprocally in the range of 360°.

6. The drill bit apparatus for drilling of claim 5, further comprising the combined high-low voltage pulse power sources and the drilling fluid supply apparatus, wherein each plasma generator is electrically connected to the combined high-low voltage pulse power source corresponding to each plasma generator, and wherein the drilling fluid outlets are in communication with the drilling fluid supply apparatus.

7. A multi-path combined high-low voltage plasma drilling method, adopting the drill bit apparatus for drilling according to claim 6 for drilling process and comprising:

rotating the drill bit at the bottom of a drilling well, allowing a plurality of combined high-low voltage pulse power sources to control the corresponding plasma generators respectively during the rotation process, so that the plasma generators emit high-frequency pulsed plasma arcs to break rocks on a wall of the drilling well; and in the process that the plasma generators emit the high-frequency pulsed plasma arcs, releasing drilling fluid by the drilling fluid supply apparatus to the bottom of the drilling well through the drilling fluid outlets.

* * * * *